US010220359B2

(12) United States Patent
Greene et al.

(10) Patent No.: US 10,220,359 B2
(45) Date of Patent: Mar. 5, 2019

(54) SPRAY CAN MIXER SYSTEM

(71) Applicants: Richard James Greene, Burnaby (CA); Tyson Marquad Dagenais, Burnaby (CA)

(72) Inventors: Richard James Greene, Burnaby (CA); Tyson Marquad Dagenais, Burnaby (CA)

( * ) Notice: Subject to any disclaimer, the term of this patent is extended or adjusted under 35 U.S.C. 154(b) by 0 days.

(21) Appl. No.: 15/629,364

(22) Filed: Jun. 21, 2017

(65) Prior Publication Data

US 2018/0369766 A1 Dec. 27, 2018

(51) Int. Cl.

| | |
|---|---|
| ***B01F 9/00*** | (2006.01) |
| ***B01F 15/00*** | (2006.01) |
| ***B01F 13/00*** | (2006.01) |
| ***B01F 3/04*** | (2006.01) |
| ***B05B 15/20*** | (2018.01) |
| *B65D 83/14* | (2006.01) |

(52) U.S. Cl.

CPC ..... *B01F 9/0016* (2013.01); *B01F 3/04028* (2013.01); *B01F 13/0028* (2013.01); *B01F 15/00538* (2013.01); *B05B 15/20* (2018.02); *B65D 83/75* (2013.01)

(58) Field of Classification Search

CPC ..... B01F 9/0016; B01F 3/04028; B01F 13/0028; B01F 15/00538; B05B 15/20; B65D 83/75

See application file for complete search history.

(56) References Cited

U.S. PATENT DOCUMENTS 5,451,105 A * 9/1995 Koering ..... A47J 43/042 366/130
9,144,777 B2 * 9/2015 Brawley ..... B01F 9/0016

OTHER PUBLICATIONS

Screenshots of Presentation provided by Applicants Representative Charles Runyan on Sep. 11, 2018. (Year: 2018).*

* cited by examiner

*Primary Examiner* — Anshu Bhatia
(74) *Attorney, Agent, or Firm* — Integrity Patent Group, PLC; Charles E. Runyan

(57) ABSTRACT

A spray can mixer system includes a spray can mixer assembly having a drive shaft, a sleeve having an inner volume, a base, and a securer. The sleeve is configured to receive an aerosol can. The securer is located at an open end of the sleeve and is configured to secure the aerosol can within the inner volume of the sleeve. The drive shaft is mounted to the base and is configured to be received by a drill to permit rotating and mixing contents of the aerosol can.

20 Claims, 5 Drawing Sheets

SPRAY CAN MIXER SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of mixing devices and more specifically relates to a spray can mixer.

2. Description of Related Art

Conventional aerosol spray cans of various typed experience the effect of settling of contents within the can after a period of storage, and require subsequent mixing of the contents prior to use. Manual shaking may be uncomfortable given that manufacturers recommend about 2 minutes of shake time. Shaking of multiple cans may be difficult. Several devices have been developed for utilizing a common homeowner tool to mix paint, but such devices are unwieldy and cumbersome to use. A suitable solution is desired.

U.S. Pat. No. 9,144,777 to Nicholas Joseph Brawley relates to an aerosol can mixing device. The described aerosol can mixing device includes an apparatus that is configured for attachment to an aerosol can to permit mixing of contents therein. The apparatus includes a generally flat base portion coupled to a drive shaft orthogonally oriented relative to the base portion, and a securing strap attached to the base portion. The securing strap is configured to engage or grip a cylindrical end portion of an aerosol can to secure the aerosol can to the apparatus, whereby the drive shaft is configured to be mounted within a drill chuck to permit the mixing apparatus to rotate an aerosol can attached thereto for mixing contents within the aerosol can.

BRIEF SUMMARY OF THE INVENTION

In view of the foregoing disadvantages inherent in the known mixing devices art, the present disclosure provides a novel spray can mixer system. The general purpose of the present disclosure, which will be described subsequently in greater detail, is to provide an aerosol can mixing apparatus for efficiently mixing contents therein.

A spray can mixer system is disclosed herein. The spray can mixer system includes a spray can mixer assembly having a drive shaft, a sleeve having an inner volume, a base, and a securer. The spray can mixer system comprises the spray can mixer assembly. The spray can mixer assembly comprises the drive shaft and the sleeve in functional combination. The sleeve is defined by the inner volume, the base, and the securer. The sleeve may comprise a cylindrical body having the inner volume with a depth approximately of a height of the aerosol can. The sleeve comprises cylindrical side walls defining an opening for receiving the aerosol can. The securer is located at an open end of the sleeve and is configured to secure the aerosol can within the inner volume of the sleeve. The drive shaft is mounted to the base and is configured to be received by a drill to permit rotating and mixing contents of the aerosol can.

The drive shaft is secured to a center portion of the base. The drive shaft comprises an elongated shaft configured to be universally received by the drill (or other tool) used. The securer comprises a retention-sleeve about a rim of the sleeve. In a preferred embodiment, the retention-sleeve is flexible and is able to be stretched around a circumference of the aerosol can and thereby secure the aerosol can within. The device effectively eliminates the need to manually shake an aerosol can including a spray paint can.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a spray can mixer system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a mixing device and more particularly to a spray can mixer system as used to improve mixing of spray paint cans and other aerosol cans.

Generally, the present invention includes a universal spray can mixer. The device relieves stress on arms and joints from manually shaking an aerosol can. The spray can mixer system mixes contents fast and allows full use of the contents. The present invention simply fits into virtually any drill chuck and a spray can may be slid into a sleeve. The spray can is held in place by a retention ring. The operator may then engage the trigger on the drill and at medium speed (preferably) and at a slight angle spin the device allowing the contents to be mixed thoroughly with ease.

Figure 1:
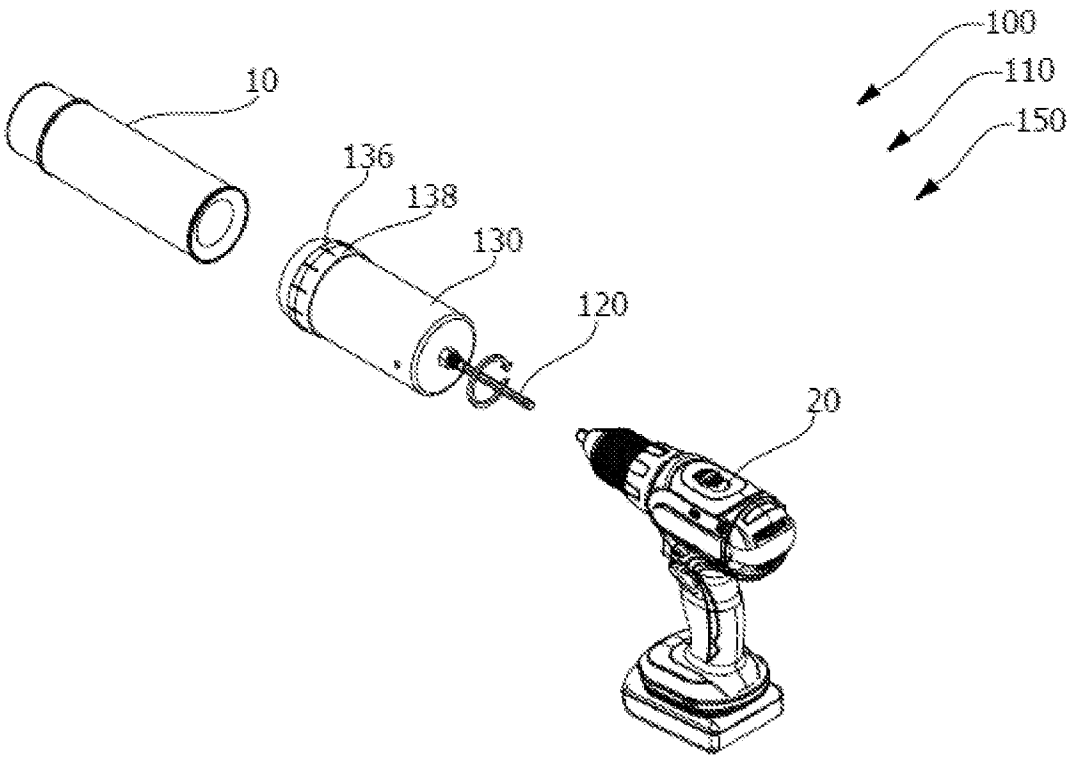
FIG. 1 is a perspective view of the spray can mixer system during an 'in-use' condition, according to an embodiment of the disclosure.

Referring now more specifically to the drawings by numerals of reference, there is shown in FIGS. 1-5, various views of a spray can mixer system 100. FIG. 1 shows a spray can mixer system 100 during an 'in-use' condition 150, according to an embodiment of the present disclosure. As illustrated, the spray can mixer system 100 may include a spray can mixer assembly 110 having a drive shaft 120, a sleeve 130 having an inner volume 132, a base 134, and a securer 136. The spray can mixer system 100 comprises the spray can mixer assembly 110.

The spray can mixer assembly 110 comprises the drive shaft 120 and the sleeve 130 in functional combination. The sleeve 130 is defined by the inner volume 132, the base 134, and the securer 136. The sleeve 130 is configured to receive an aerosol can 10. The securer 136 is located at an open end of the sleeve 130 and is configured to secure the aerosol can 10 within the inner volume 132 of the sleeve 130. The drive shaft 120 is mounted to the base 134 and is configured to be received by a chuck of a drill 20 to permit rotating and mixing contents of the aerosol can 10. Other tools may be used for manipulating the aerosol can 10.

Figure 2:
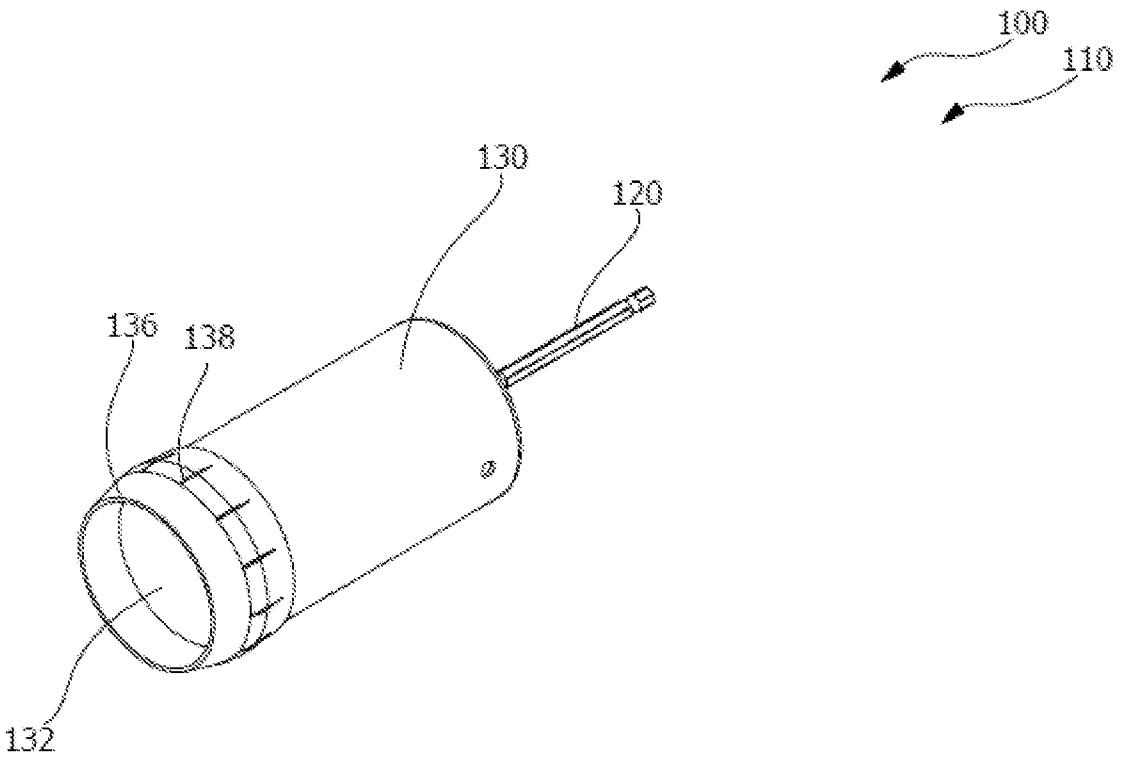
FIG. 2 is a perspective view of the spray can mixer system of FIG. 1, according to an embodiment of the present disclosure.

FIG. 2 shows a perspective view of the spray can mixer system 100 of FIG. 1, according to an embodiment of the present disclosure. As above, the spray can mixer system 100 may include a spray can mixer assembly 110 having a drive shaft 120, a sleeve 130 having an inner volume 132, a base 134, and a securer 136. The sleeve 130 comprises a cylindrical body having the inner volume 132 with a depth approximately of a height of the aerosol can 10. In a preferred embodiment, the sleeve 130 comprises cylindrical side walls defining an opening for receiving the aerosol can 10. The cylindrical side walls may be rigid for suitably supporting the aerosol can 10.

Figure 3:
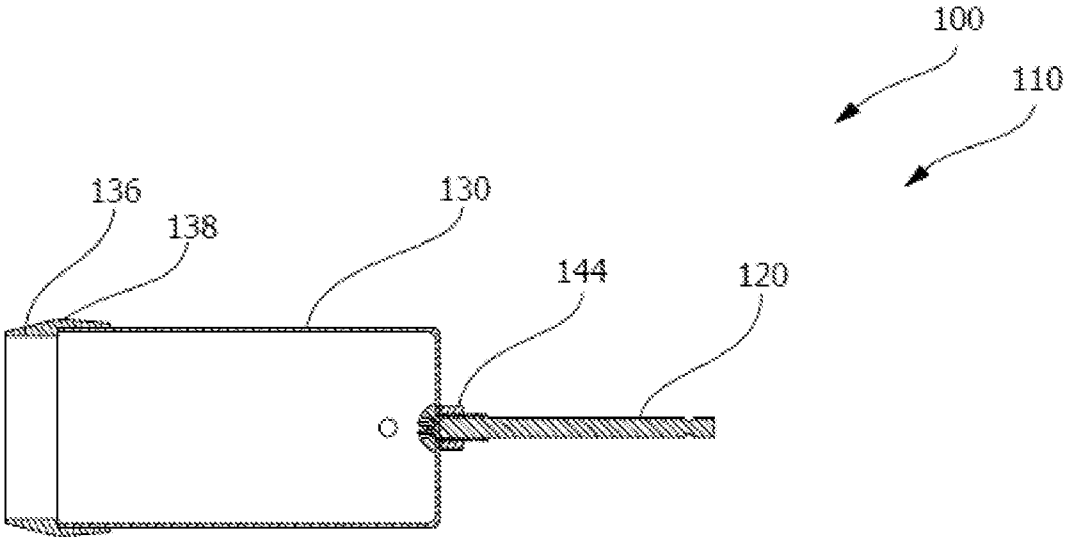
FIG. 3 is a perspective view of the spray can mixer system of FIG. 1, according to an embodiment of the present disclosure.

FIG. 3 shows a perspective view of the spray can mixer system 100 of FIG. 1, according to an embodiment of the present disclosure. As above, the spray can mixer system 100 may include a spray can mixer assembly 110 having a drive shaft 120, a sleeve 130 having an inner volume 132, a base 134, and a securer 136. The drive shaft 120 is secured to a center portion of the base 134. The drive shaft 120 comprises an elongated shaft configured to be universally received by the drill 20. The drive shaft 120 may be secured to a center portion of the base 134 via at least one fastener 144. The at least one fastener 144 may comprise a bolt or other suitable fastening means. The drive shaft 120 may comprise a screw-fastener and threading at a distal end in preferred embodiments.

Figure 4:
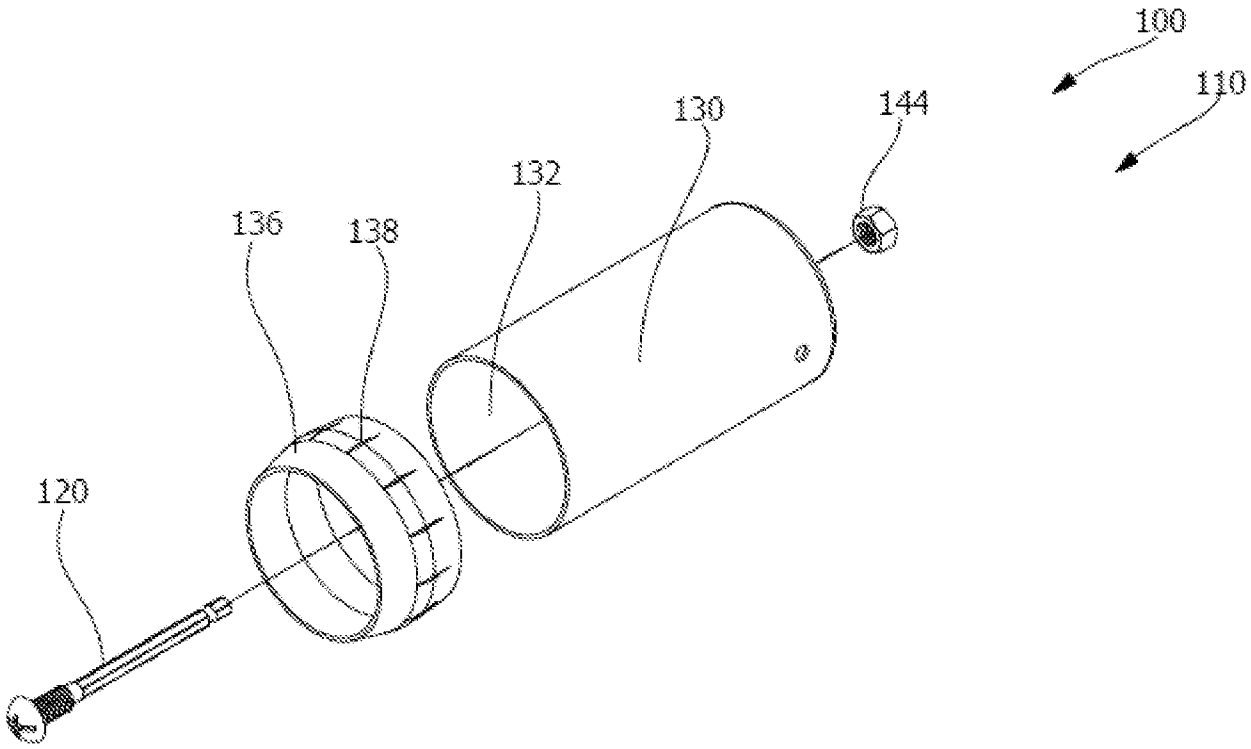
FIG. 4 is a perspective view of the spray can mixer system of FIG. 1, according to an embodiment of the present disclosure.

FIG. 4 shows a perspective view of the spray can mixer system 100 of FIG. 1, according to an embodiment of the present disclosure. As above, the spray can mixer system 100 may include spray can mixer assembly 110 having a drive shaft 120, a sleeve 130 having an inner volume 132, a base 134, and a securer 136. The securer 136 may comprise a retention-sleeve 138 about a rim of the sleeve 130. The retention-sleeve 138 is preferably non-rigid. In a preferred embodiment, the retention-sleeve 138 is flexible and is able to be stretched around a circumference of an aerosol can 10 and secure the aerosol can 10 therewithin. The aerosol can 10 may comprise a spray paint can. The aerosol can 10 may be removably coupleable within the sleeve 130.

Figure 5:
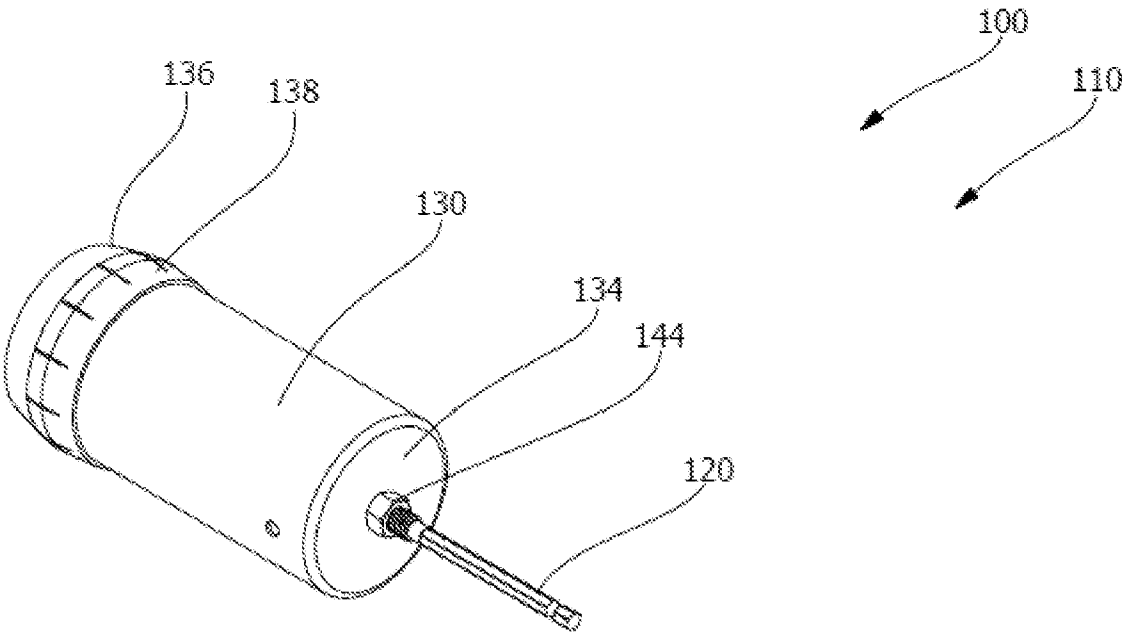
FIG. 5 is a perspective view of the spray can mixer system of FIG. 1, according to an embodiment of the present disclosure.

FIG. 5 shows a perspective view of the spray can mixer system 100 of FIG. 1, according to an embodiment of the present disclosure. As above, the spray can mixer system 100 may include spray can mixer assembly 110 having a drive shaft 120, and a sleeve 130 having an inner volume 132, a base 134, and a securer 136. The drive shaft 120 may be secured to a center portion of the base 134 of the sleeve 130. A distal end of the drive shaft 120 includes a screw-fastener and threading in preferred embodiments however other coupling means may be used. The drive shaft 120 may be secured to the center portion of the base 134 via at least one fastener 144. The at least one fastener 144 may comprise a bolt which may be fastened via the threading located on the distal end of the drive shaft 120. Other suitable fastening means may be used for securing the sleeve 130 to the drive shaft 120. The drive shaft 120 may then be temporarily attached to a drill 20 (via a chuck or the like) for rotating the device and mixing contents of an aerosol can 10.

The present invention may find use within a method by coupling the aerosol can 10 into the device, as described, mixing the contents then using the aerosol can 10 for spraying.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A spray can mixer system comprising:
- a spray can mixer assembly having
  - a drive shaft;
  - and
  - a sleeve having
    - wall having a base end and an open end;
    - a base connected to the base end;
    - and
    - a securer connected at the open end,
- wherein said spray can mixer assembly comprises said drive shaft and said sleeve in functional combination;
- wherein said sleeve is defined by said wall, said base, and said securer;
- wherein said sleeve is configured to receive an aerosol can;
- wherein said securer is configured to secure said aerosol can within said sleeve; and
- wherein said drive shaft is mounted to said base and is configured to combine with a drill.

2. The spray can mixer system of claim 1, wherein said wall is cylindrical.

3. The spray can mixer system of claim 1, wherein said sleeve has a depth approximately equal to a height of said aerosol can.

4. The spray can mixer system of claim 3, wherein said wall defines an opening for receiving said aerosol can.

5. The spray can mixer system of claim 1, wherein said drive shaft is secured to a center portion of said base.

6. The spray can mixer system of claim 5, wherein said drive shaft comprises an elongated shaft configured to be universally received by a chuck of said drill.

7. The spray can mixer system of claim 6, wherein said drive shaft is secured to a center portion of said base via at least one fastener.

8. The spray can mixer system of claim 7, wherein said fastener comprises a bolt.

9. The spray can mixer system of claim 1, wherein said aerosol can comprises a spray paint can.

10. The spray can mixer system of claim 1, wherein said aerosol can is removably couplable within said sleeve.

11. The spray can mixer system of claim 2, wherein said wall is rigid.

12. The spray can mixer system of claim 1, wherein said securer comprises a retention-sleeve.

13. The spray can mixer system of claim 12, wherein said retention-sleeve is stretchable.

14. The spray can mixer system of claim 1, wherein said drive shaft comprises threading at a distal end.

15. The spray can mixer system of claim 1, wherein said drive shaft comprises a screw-fastener at a distal end.

16. A spray can mixer system comprising:

a spray can mixer assembly having a drive shaft;

and a sleeve having a cylindrical wall having a base end and an open end;

a base connected to the base end;

and a securer connected at the open end, wherein said spray can mixer assembly comprises said drive shaft and said sleeve in functional combination;

wherein said sleeve is defined by said wall, said base, and said securer;

wherein said sleeve is configured to receive an aerosol can;

wherein said sleeve has a depth approximately equal to a height of said aerosol can;

wherein said wall defines an opening for receiving said aerosol can;

wherein said wall is rigid;

wherein said aerosol can comprises a spray paint can;

wherein said aerosol can is removably couplable within said sleeve;

wherein said securer is configured to secure said aerosol can within said sleeve;

wherein said drive shaft comprises an elongated shaft configured to be universally received by a drill;

wherein said drive shaft is secured to a center portion of said base via threading at a distal end;

and wherein said securer comprises a stretchable retention-sleeve.

17. The spray can mixer system of claim 2 wherein said wall is rigid and said securer comprises a non-rigid retention-sleeve.

18. The spray can mixer system of claim 1 wherein the open end comprises a tip and wherein the securer connects to the tip.

19. The spray can mixer system of claim 18 wherein said securer comprises a retention-sleeve.

20. The spray can mixer system of claim 19 wherein said retention-sleeve is stretchable.

* * * * *